US007418744B2

(12) United States Patent
Smitherman

(10) Patent No.: US 7,418,744 B2
(45) Date of Patent: Sep. 2, 2008

(54) NOISE REDUCING FLOAT FOR TOILET BOWL

(76) Inventor: Eugene A. Smitherman, 55 E. Broad Oaks, Houston, TX (US) 77056

( * ) Notice: Subject to any disclaimer, the term of this patent is extended or adjusted under 35 U.S.C. 154(b) by 296 days.

(21) Appl. No.: 11/161,772

(22) Filed: Aug. 16, 2005

(65) Prior Publication Data

US 2007/0039096 A1 Feb. 22, 2007

(51) Int. Cl.
*E03D 9/00* (2006.01)
*F15D 1/00* (2006.01)

(52) U.S. Cl. ..... 4/300.3

(58) Field of Classification Search ..... 4/300.3, 4/661; 441/131

See application file for complete search history.

(56) References Cited

U.S. PATENT DOCUMENTS 4,774,730 A * 10/1988 Ho ..... 4/300.3
6,513,172 B1 * 2/2003 Norton ..... 4/300.3
2004/0034909 A1 * 2/2004 Grueser ..... 4/300.3

FOREIGN PATENT DOCUMENTS

JP 5-247988 * 5/1993

* cited by examiner

*Primary Examiner*—Charles E. Phillips
(74) *Attorney, Agent, or Firm*—Law Office of Tim Cook P.C.

(57) ABSTRACT

A float with a mesh over it floats on the surface of the water in a toilet bowl. The float is preferably toroidal and the mesh is held by the toroid by a distance above the water in the toilet. The toroidal float is preferably circular or tear drop shaped in cross section. The float and mesh arrangement reduces the noise created by a urine stream directed into the water in the toilet bowl.

6 Claims, 1 Drawing Sheet

NOISE REDUCING FLOAT FOR TOILET BOWL

FIELD OF THE INVENTION

The present invention relates generally to the field of toilets and, more particularly, to a float adapted to reduce the noise level of a urine stream directed into a toilet bowl.

BACKGROUND OF THE INVENTION

A stream of urine directed into a toilet bowl from a standing height creates a noise that may be annoying to others. For example, late at night such a noise may awaken others sleeping adjacent a bathroom where one is urinating and creating this annoying noise.

Some people try to alleviate this problem by directing the urine stream toward the side of the toilet bowl. Unfortunately, this often results in the urine stream being directed outside of the toilet bowl and onto the bathroom floor.

Thus, there remains a need for a means of reducing the noise of a urine stream directed into a toilet bowl while eliminating the need to direct a urine stream toward the side of the toilet bowl. The present invention is directed to solving this need in the art.

SUMMARY OF THE INVENTION

The present invention solves these and other needs in the art by providing a float with a mesh over it. The float is preferably toroidal and the mesh is held by the toroid by a distance above the water in the toilet. The toroidal float is preferably circular in cross section, and in another embodiment the toroidal float has a rounded peak at the top of the float cross section. This embodiment further reduces the tendency of the urine to splash as it strikes the toroidal float.

The float is preferably formed of a plastic material and is hollow. Alternatively, the float may be formed of a foam material, and then coated with the waterproof cladding to eliminate the tendency of urine to soak into the foam. Also, the float and mesh are made of a washable combination so that the float may be disinfected, as needed.

The float is preferably larger than the discharge opening at the bottom of the toilet bowl. In this way, as the toilet is flushed, the water and waste are flushed out of the toilet while the float remains within the bowl without going down the drain. Alternatively, or in addition, the float may be attached with an umbilical to the rim of the toilet.

These and other features, objects, and advantages of the present invention will be apparent to those of skill in the art from a review of the following detailed disclosure.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF PREFERRED EMBODIMENTS

Figure 1:
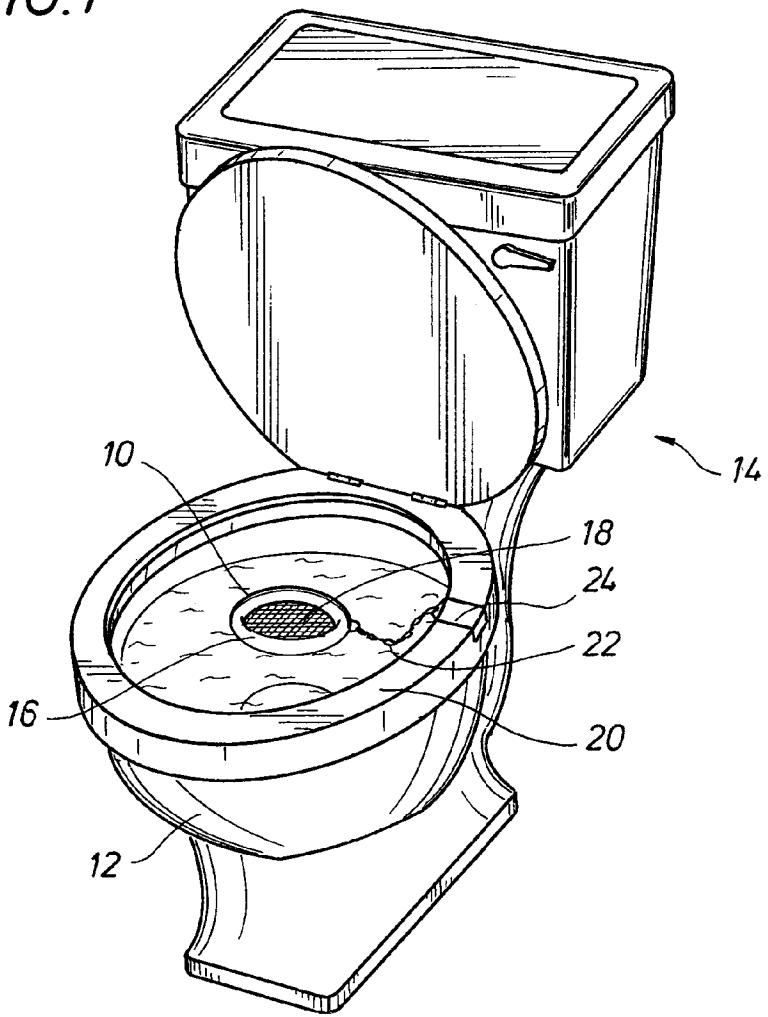
FIG. 1 is a perspective view of a toilet with a float of the present invention therein.

FIG. 1 depicts a float 10 of the present invention floating a bowl 12 of a toilet 14. The float 10 comprises a buoyant member 16 over which is affixed a screen 18. The screen 18 is preferably an open mesh, although other structures may be used.

The float 10 may be permitted to float freely within the bowl 12, or it may be loosely secured to a rim 20 of the bowl 12 by means of an umbilical 22. The umbilical 22 may be formed of a chain, as shown in FIG. 1, or any other appropriate material adapted for the environment. The umbilical 22 may be secured to the rim 20 with a clip 24 over the rim. In any event, the umbilical 22 serves to tether the float to the toilet bowl. Otherwise, the float should be big enough that it is not flushed down the drain outlet of the toilet bowl when the toilet is flushed. Alternatively, the umbilical may terminate in a ring or similar structure that may be grasped by the user and that typically hangs outside the toilet bowl. Then, a user may grasp the ring to lift the float outside the toilet bowl and temporarily deposit the float into a trash can or the like. When the user then wishes to use the float, he grasps the ring, lifts the float from the trash can and places the float into the toilet bowl. The process is then reversed when the float is no longer needed in the toilet bowl.

Figure 2:
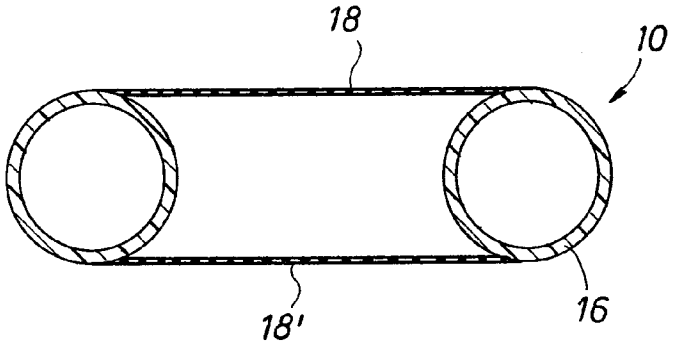
FIG. 2 is a side section view of a float of this invention.
Figure 3:
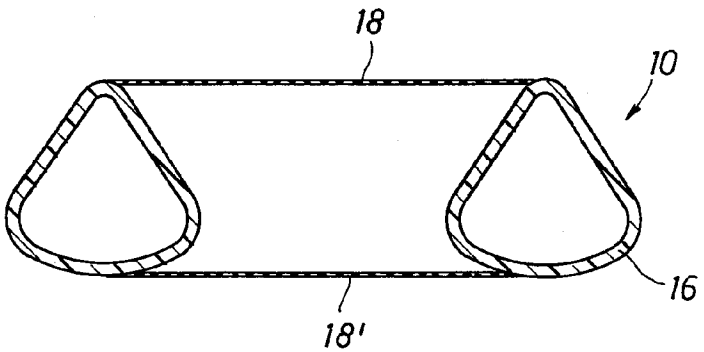
FIG. 3 is a side section view of a float of this invention with a different profile.

FIGS. 2 and 3 illustrate the float of this invention in section view. FIG. 2 illustrates a float 10 wherein the buoyant member 16 has a circular cross section. The screen 18 is stretched across the top of the buoyant member 16, and another screen 18' may be provided on the bottom, so that the float can be oriented in the bowl with either side up. The screen is preferably a plastic material, although any appropriate material may be used which will last in the environment of the toilet bowl without deteriorating or rusting. The screen may be attached to the buoyant member by heat sealing, gluing, or other means.

FIG. 3 shows the buoyant member having a teardrop shaped cross section. While this embodiment may also include the screen 18' on the bottom, it is not exactly reversible. However, this embodiment offers the advantage of having less splash as a urine stream strikes the top of the buoyant member 16. Other preferred cross sectional shapes may also be used. In either embodiment, the float and screen arrangement reduces the noise created by a urine stream directed onto the surface of the water in the toilet bowl. It should also be apparent to those of skill in the art that both embodiments illustrated in FIGS. 2 and 3 include a vertical opening or channel 26 with a screen stretched across the opening. The urine stream is directed onto the screen across the opening, thereby reducing a pace of the stream as it strikes the surface of the water in the toilet bowl.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

What is claimed is:

1. A float for use on the surface of the water in a toilet bowl, the float comprising:

a toroidal buoyant member having a vertical opening therethrough, wherein the buoyant member defines a teardrop shaped cross section; and a screen stretched across the vertical opening.

2. The float of claim 1, wherein the screen is an open mesh.

3. The float of claim 1, further comprising means to tether the float to the toilet bowl.

4. The float of claim 3, wherein the means to tether includes an umbilical joined to a clip, adapted to attach to a rim of the toilet.

5. The float of claim 1, wherein the toilet defines a drain outlet of a predetermined diameter, and wherein the float defines a diameter which is greater than diameter of the drain outlet.

6. The float of claim 1, wherein the buoyant member comprises a foam material coated with a waterproof plastic covering.

* * * * *